United States Patent [19]

Hayashi et al.

[11] 4,119,416

[45] Oct. 10, 1978

[54] ELECTROSTATIC PRECIPITATOR

[75] Inventors: Kazuo Hayashi; Ken Kamijo, both of Yokohama, Japan

[73] Assignee: Nissan Motor Company, Ltd., Yokohama, Japan

[21] Appl. No.: 808,683

[22] Filed: Jun. 22, 1977

[51] Int. Cl.[2] ..... B03C 3/00

[52] U.S. Cl. ..... 55/136; 55/151

[58] Field of Search ..... 55/138, 136, 151

[56] References Cited

U.S. PATENT DOCUMENTS

| | | | |
|---|---|---|---|
| 2,698,669 | 1/1955 | Wintermute | 55/138 |
| 3,704,572 | 12/1972 | Gourdine et al. | 55/138 |
| 3,958,962 | 5/1976 | Hayashi | 55/138 |

FOREIGN PATENT DOCUMENTS

| | | | |
|---|---|---|---|
| 1,410,881 | 8/1965 | France | 55/151 |

*Primary Examiner*—Bernard Nozick

*Attorney, Agent, or Firm*—Lane, Aitken, Dunner & Ziems

[57] ABSTRACT

An electrostatic precipitator comprises at least a pair of parallel collecting plate electrodes between which is disposed an auxiliary plate electrode biased at an opposite potential to the potential applied to the collecting plate electrodes and a corona discharge electrode spaced predetermined distances from said collecting and auxiliary plate electrodes and biased at the same potential as that applied to the auxiliary plate electrode.

2 Claims, 5 Drawing Figures

ELECTROSTATIC PRECIPITATOR

FIELD OF THE INVENTION

The present invention relates to electrostatic precipitators.

BACKGROUND OF THE INVENTION

The basic unit of a prior art electrostatic precipitator includes, as shown in FIG. 1 of the drawings, a pair of parallel identical grounded plate electrodes 2 between which is disposed a pair of parallel plate anode electrodes 3 of shorter length than electrodes 2 and another grounded plate electrode 4 of the same length as that of the anode electrode 3 therebetween. A corona discharge wire electrode 1 is positioned forwardly of the grounded plate electrode 4 and biased at twice as high potential as that applied to the anode electrode 3. For actual practice, a plurality of such units is arranged successively to increase the collecting capacity of the precipitator. In this prior art construction, a stream of air is introduced from the left side or forward end of the precipitator and the dust particles contained in the air stream may become charged as they pass through the corona discharge area and then collected by the grounded or collecting plate electrodes. However, this prior art construction necessitates the use of two positive potentials which would add to the complexity of a power source and the corona discharge electrode 1 must be supported separately from the other electrodes to ensure good electrical isolation therebetween.

SUMMARY OF THE INVENTION

In accordance with the invention, the basic unit of an electrostatic precipitator comprises a pair of grounded or collecting plate electrodes, a corona discharge electrode and an auxiliary plate electrode biased at the same potential as the corona discharge electrode. The corona discharge and auxiliary plate electrodes are disposed between the grounded plate electrodes and the former is spaced a predetermined distance from the forward edge of the auxiliary plate electrode and from each of the grounded plate electrodes. Dust particles as they pass in the neighborhood of the corona discharge electrode are positively charged and then collected by the collecting plate electrodes. The auxiliary plate electrode serves to accelerate the ionized particles to the collectplate electrodes. The corona discharge electrode is positioned from the other electrodes so that the dust collecting efficiency is at the maximum.

Therefore, an object of the invention is to provide an electrostatic precipitator whose collecting efficiency is improved over the prior art apparatus.

Another object is to provide an electrostatic precipitator which is simple in construction and permits the simplification of its power source.

BRIEF DESCRIPTION OF THE DRAWINGS

The invention will be described further with reference to the accompanying drawings, in which.

DESCRIPTION OF THE PREFERRED EMBODIMENT

Figure 1:
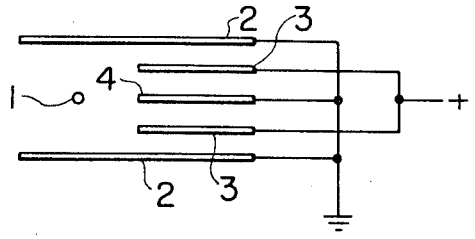
FIG. 1 PRIOR ART
FIG. 1 is a side elevational view of the basic unit of a prior art electrostatic precipitator.
Figure 2:
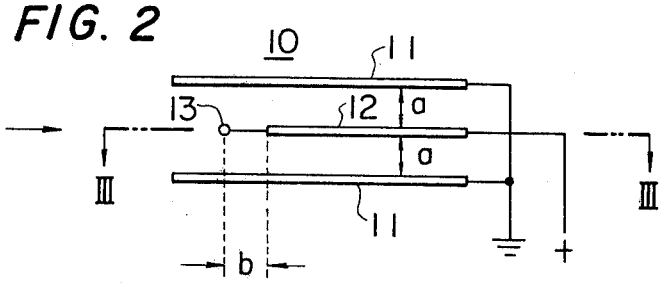
FIG. 2 is a side elevational view of the basic unit of an electrostatic precipitator of the invention.
Figure 3:
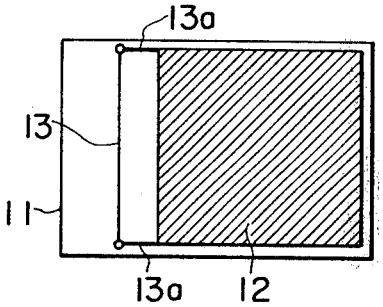
FIG. 3 is a cross-sectional view taken along the lines III—III of FIG. 2.

Referring now to FIGS. 2 and 3, an electrostatic precipitator 10 embodying the present invention is shown as comprising a pair of dust collecting parallel plate electrodes 11 which are connected to ground and an auxiliary plate electrode 12 smaller in length than the collecting electrodes 11 and disposed between the collecting electrodes 11 at equal spacing *a* therefrom, and a wire electrode 13 disposed parallel to the forward edge of the auxiliary plate electrode 12 at a spacing *b* therefrom. The electrodes 12 and 13 are suitably connected together by conductors 13*a* and biased at a high positive potential so that these electrodes are at a positive equipotential with respect to the collecting electrodes 11.

Figure 4:
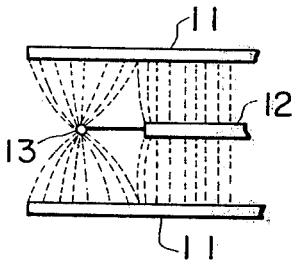
FIG. 4 shows the electric field lines of the precipitator of FIG. 2.

The electric field lines that make up the corona discharge field emanate from the wire electrode 13 toward the oppositely charged electrodes 11 and this corona discharge field is adjoined by uniform electric fields between the oppositely charged plates 11 and 12 as illustrated in FIG. 4. A stream of air is introduced in a direction indicated by the arrow in FIG. 2 and dust particles in the stream may become charged by the corona discharge field and then collected by the grounded electrodes 11 as they proceed through the electrodes 11 and 12.

Since the intensity of an electric field depends on the charge density on the surface of a charged body, the amount of charged dust particles is maximized by increasing the surface charge density of the wire electrode 13. Specifically, the equipotential electrode 12 acts in a way to constrict the corona discharge field so that the upper and lower surface charge densities is increased.

The precipitator in accordance with the invention was manufactured with various ratios of spacing *a* to spacing *b*, and the electrodes 11, 12 and 13 are applied with a voltage which in the absence of dust particles reaches a point where a corona discharge occurs.

Figure 5:
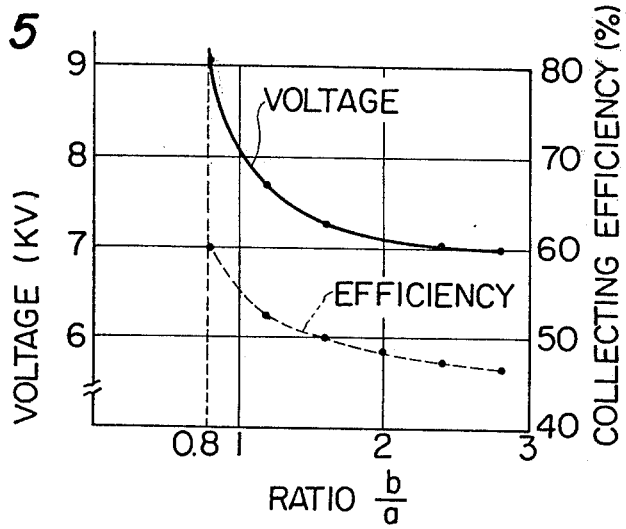
FIG. 5 is a graphic illustration of the characteristics of the precipitator of the invention showing the permissible voltage and the collecting efficiency as a function of the spacing between the corona discharge electrode and other electrode.

The voltage curve shown in FIG. 5 is a permissible voltage for a particular set of spacings *a* and *b* and the voltage above that curve will generate a corona discharge in the absence of dust. It will be noted that the collecting efficiency of the precipitator 10 reaches a maximum point when the ratio of spacings *a* to *b* is 1:0.8. It was found that with the spacing *b* being smaller than 0.8 *a*, the permissible voltage sharply jumped to an extremely high voltage and electric spark occurred between electrodes 13 and 11, and as a result the electric field surrounding the electrode 13 became instable. The dust collecting efficiency sharply decreases at the ratio *b/a* is above 1.0.

In consideration of manufacturing tolerance and the usable range of collecting efficiency, the most preferred value of the ratio of *a* to *b* was found to exist in the range from 1:0.8 to 1:1.

What is claimed is:

1. An electrostatic precipitator comprising at least one pair of parallel collecting plate electrodes connected to a first terminal of a potential source, an auxiliary plate electrode disposed between said collecting electrodes and connected to a second terminal of said potential source, a wire electrode extending parallel to a front edge of said auxiliary plate electrode and disposed between said parallel collecting electrodes, said wire electrode being spaced a distance *a* from each of said collecting electrodes and being spaced a distance *b* from said front edge of said auxiliary plate electrode and connected to said second terminal of said potential source, the ratio of *a* to *b* being substantially within a range of between 1:0.8 to 1:1.

2. An electrostatic precipitator as claimed in claim 1, wherein said wire electrode is connected with and supported by said auxiliary plate electrode.

* * * * *